US006824640B2

(12) United States Patent
Brockman

(10) Patent No.: US 6,824,640 B2
(45) Date of Patent: Nov. 30, 2004

(54) METHOD OF FABRICATION OF MULTIPLE MANIPULATION SHIELDS AND CONTAINMENTS FOR CONTAMINATED MATTER

(76) Inventor: Robert Brockman, 2928 Elmwood Ave., Bakersfield, CA (US) 93305

( * ) Notice: Subject to any disclaimer, the term of this patent is extended or adjusted under 35 U.S.C. 154(b) by 203 days.

(21) Appl. No.: 10/325,543

(22) Filed: Dec. 18, 2002

(65) Prior Publication Data

US 2004/0019952 A1 Feb. 5, 2004

Related U.S. Application Data

(63) Continuation-in-part of application No. 10/074,657, filed on Feb. 14, 2002, now abandoned.

(51) Int. Cl.[7] ..... B32B 31/00; B32B 31/20

(52) U.S. Cl. ..... 156/251; 156/272.2; 156/308.4

(58) Field of Search ..... 156/251, 272.2, 156/308.4

(56) References Cited

U.S. PATENT DOCUMENTS 5,632,846 A * 5/1997 Ross ..... 156/308.4
5,759,333 A * 6/1998 Ross ..... 156/308.4

* cited by examiner

*Primary Examiner*—Stephen J. Lechert, Jr.

(57) ABSTRACT

A method is devised for continuous fabrication of thin membrane gloved enclosures in which a folded membrane ribbon is closed along the opposed longitudinal edges by a reversible closure comprising an interlocking set of beads. The ribbon is then repetitively stamped by a heated filament in the shape of a joined string of gloved enclosure and the interlocked beads are then separated, folded over to overlie the gaps formed and a second severing operation then parts the individual enclosures. In this manner a cuff is formed that can then be extended on top of an article grasped.

14 Claims, 5 Drawing Sheets

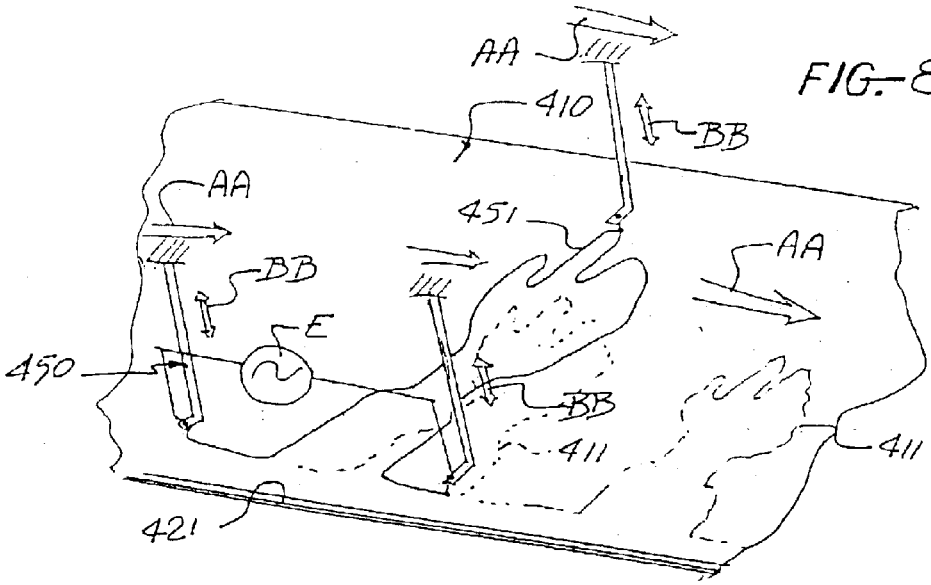
FIG. 8
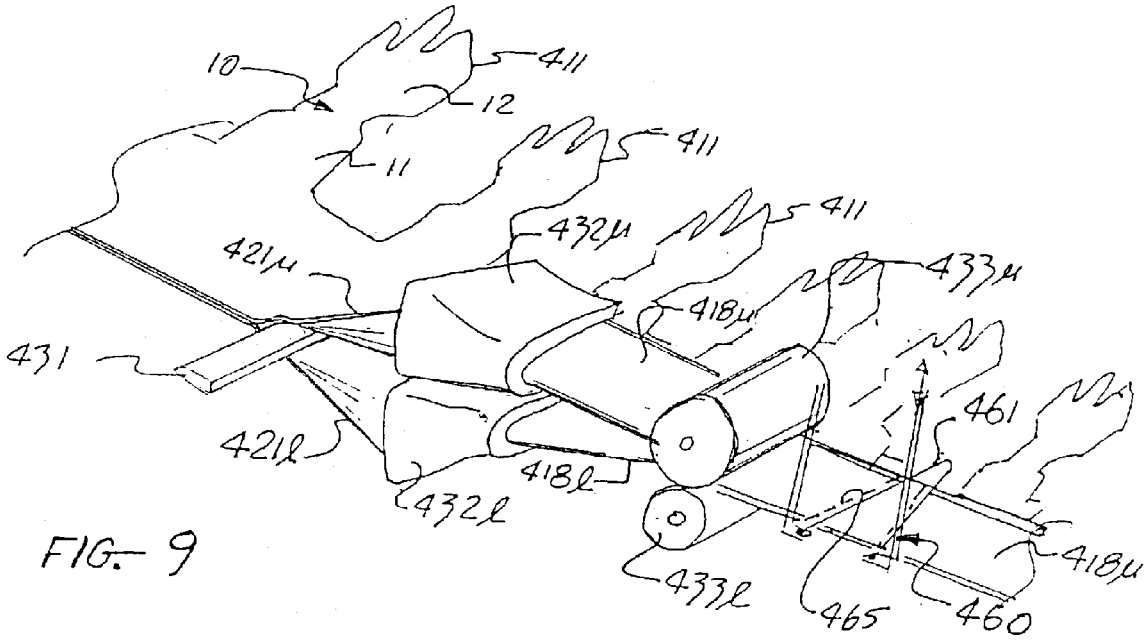
FIG. 9
FIG. 12b
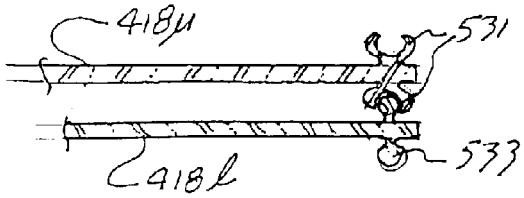

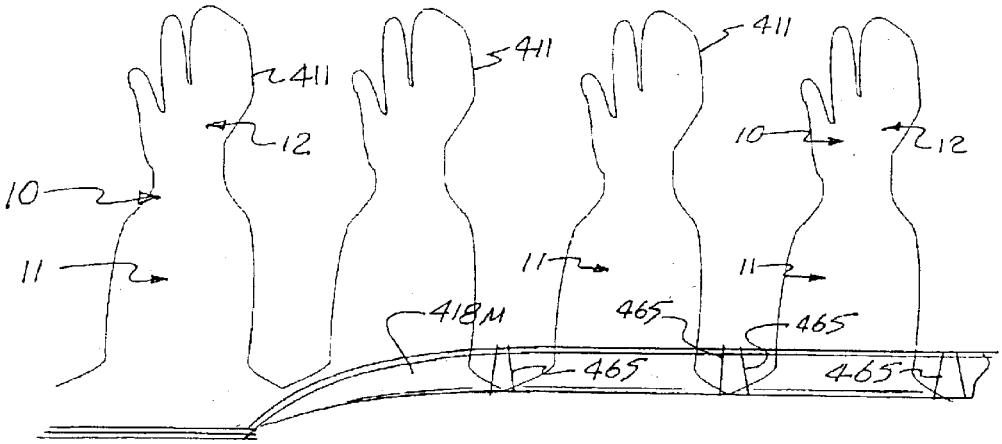
FIG. 10
FIG. 11
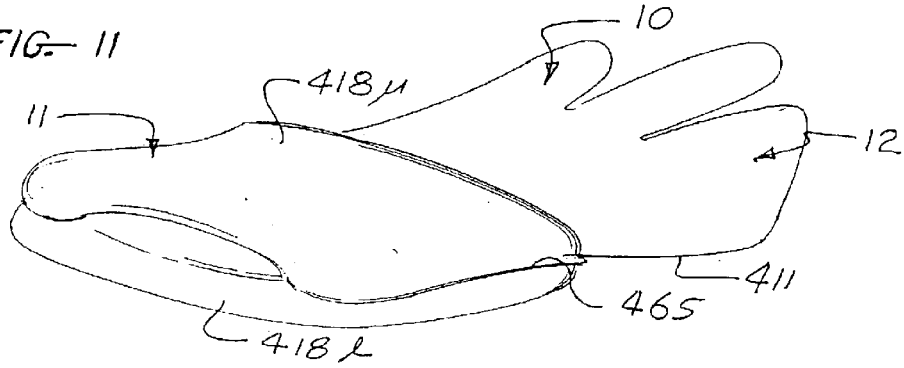
FIG. 12a
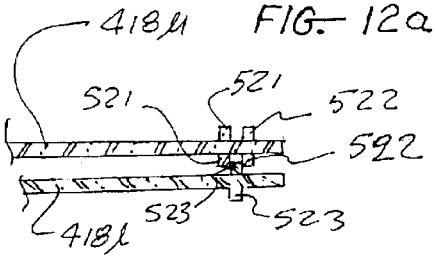

METHOD OF FABRICATION OF MULTIPLE MANIPULATION SHIELDS AND CONTAINMENTS FOR CONTAMINATED MATTER

REFERENCE TO RELATED APPLICATIONS

This application is a continuation-in-part of the matter disclosed in U.S. application Ser. No. 10/074,657 filed on Feb. 14, 2002 now abandoned. Applicant claims the benefit of this earlier filing date for all matter common to this earlier application.

BACKGROUND OF THE INVENTION

1. Field of the Invention

The present invention relates to containment techniques and devices for hazardous matter, and more particularly to a flexible manipulation enclosure within which articles suspected to be contaminated can be examined and thereafter stored.

2. Description of the Prior Art

Recent events have significantly affected the conduct of everyday life, particularly in those instances that are susceptible to mischief, sabotage or even terror. Amongst these are the ordinary delivery processes like the mail or parcel delivery which have been subverted for dissemination of hazardous matter to the public at large. The resulting potential for disruption of the ordinary processes of commerce has an enormous consequence on the whole economy, and the long-term effects cannot be overstated. As result, various techniques are currently sought to attenuate this threat.

A major aspect of any response to a chemical or biological hazard is the safe collection and storage of all articles that are suspected to have been contaminated, with the range of article suspects increasing with the virulence of the hazard. Good analytical processes then require that this collection be effected in organized logical patterns in which the individual articles are identified and separately enclosed to reduce any incidents of cross-contamination. This analytical technique is then helpful in revealing both the source of the hazardous substance and the mechanism of its delivery, information that is critical in any response.

In the past various techniques and structures have been devised which in one manner or another shield the person that is engaged in manipulation of hazardous tasks or matter. Most frequently such shielding structures are exemplified by devices referred to as the "glove box" in which the user inserts his hands into the interior of a cavity through affixed rubber gloves. Exemplary glove boxes useful in shielding the person from hazards of sandblasting abrasion is described in U.S. Pat. No. 6,099,395 to Guseman; a sterile shielding structures useful in the course of surgical treatment of highly infectious maladies described in U.S. Pat. Nos. 5,316,541 to Fischer; an enclosure for containing welding gases in U.S. Pat. No. 5,685,771 to Kleppen; and others. Each of these, while suitable for the purposes intended, entails a generally complex enclosure that is therefore expensive. This expense limits the discardable aspects of the device, particularly in a household setting. Moreover, the complexity and physical size of these structures renders such less than fully useful for sealing and conveniently storing the inspected mail article until the suspicions regarding its contamination are resolved.

Of course, there are other instances where manipulative convenience is desired in a discardable enclosure. For example, those engaged in home repairs often need to manipulate and thereafter discard soiled plumbing pieces and the simple task of an automobile oil filter replacement requires manipulative grasping and sealed confinement of the filter that is then discarded. Thus there are numerous instances where shielded manipulation is desired and once effected the manipulated article needs to enclosed and discarded. A technique for massproducing an inexpensive, discardable and sealable manipulation shield is therefore extensively sought and is one such shield that is disclosed herein.

SUMMARY OF THE INVENTION

Accordingly, it is the general purpose and object of the present invention to provide an inexpensively fabricated flexible glove structure including a sealable edge.

Other objects of the invention are to provide a fabrication process for producing in multiples a flexible glove extending from an enlarged tubular wrist segment that includes a sealable edge at the opening thereof.

Yet further objects of the invention are to provide an inexpensively produced flexible tubular enclosure formed of a transparent polymer sheet, terminating at one end in a glove and including a sealable edge at the other end.

Additional objects of the invention are to provide a discardable manipulation shield that is also adapted to contain and seal the article manipulated.

Briefly, these and other objects are accomplished within the present invention by providing a fabrication process for producing a flexible, reversible transparent glove formed to extend at its wrist opening from one end of a tubular enclosure provided with a sealable edge at its other end. Preferably both the glove and the enclosure are fabricated as a single piece with the enclosure defining a substantially larger envelope. With the user's arm inserted, the enclosure can then be turned inside-out and pulled over to surround any article grasped by the glove. Once so aligned to envelope the grasped article the sealable edge at the enclosure can then be closed, sealing the article therein. The article thus sealed can then be taken for analysis or can be collected for safe disposal.

Those in the art will appreciate that the foregoing glove and arm cover combination is particularly conformed as an inexpensive article that may be fabricated by heated filament stamping of any one of the several polymer sheet material structures like, for example, clear polyethylene film. Unlike the dexterity necessary for surgical procedures the function of the present inventive shielding structure needs to accommodate only such manipulations as may be necessary to lift and then enclose the article suspected of contamination and the shielding envelope, therefore, can be effected in a form that is even less expensive than a surgical glove. The seal itself may be effected as a simple adhesive strip covered by ribbon that may be peeled off when sealing is desired, or may take the seal structure sold under the mark or symbol "ZipLoc" by S C Johnson. In this manner a convenient, inexpensive and therefore discardable shielding envelope is devised which is useful in a home to manipulate envelopes and packages delivered while such are enclosed, useful in hazardous substances collection and also in the collection of evidence or samples in the course of any criminal or scientific investigation.

For those applications where two handed grasping is necessary a plastic bag may be provided with a glove in each bottom corner, with the user's arms then extending through the bag to each glove. As before, the bag opening may include a sealing strip to effect a seal once the bag is turned inside-out and extended over the article.

In both forms the inventive shielding envelope can be inexpensively produced in a ribbon heat stamping process which utilizes the process of heat 'welding' of folded ribbons of thermoplastic film, the fold being joined along one edge by a fully reversible set of interlocking beads. In the course of the fabrication sequence a series of gloved enclosures are formed adjacent the interlocked edge, by sequential heated filament stamping, the interlocked edge being then separated and folded over to partly overlie the formed enclosures. The reversed edge beads are then pressed together to interlock once again at those portions of the robbon that have been removed to be then followed by a further heat filament severing step that forms the final gloved enclosurewith the edge opening folded over for convenient use. Thus a simple and effective fabrication process is devised for producing inexpensive shielding enclosures.

BRIEF DESCRIPTION OF THE DRAWINGS

FIG. 8 is a diagrammatic illustration, in perspective, of an inventive heated filament stamping system useful in repetitive stamping of a folded, moving thermoplastic ribbon to form a series of inventive shields;

FIG. 9 is yet another diagrammatic illustration, in perspective, of a further portion of the system shown in FIG. 8;

FIG. 10 is a plan view of a continuous ribbon of gloved shieding enclosures formed in the course of operation of the system shown in FIG. 8;

FIG. 11 is a perspective illustration of one gloved enclosure severed from the continuous ribbon according to the operation of the portion shoen in FIG. 9; and FIGS. 12*a* and 12*b* are alternative sectional views taken along line 12—12 of FIG. 10.

DESCRIPTION OF THE PREFERRED EMBODIMENTS

Figure 1:
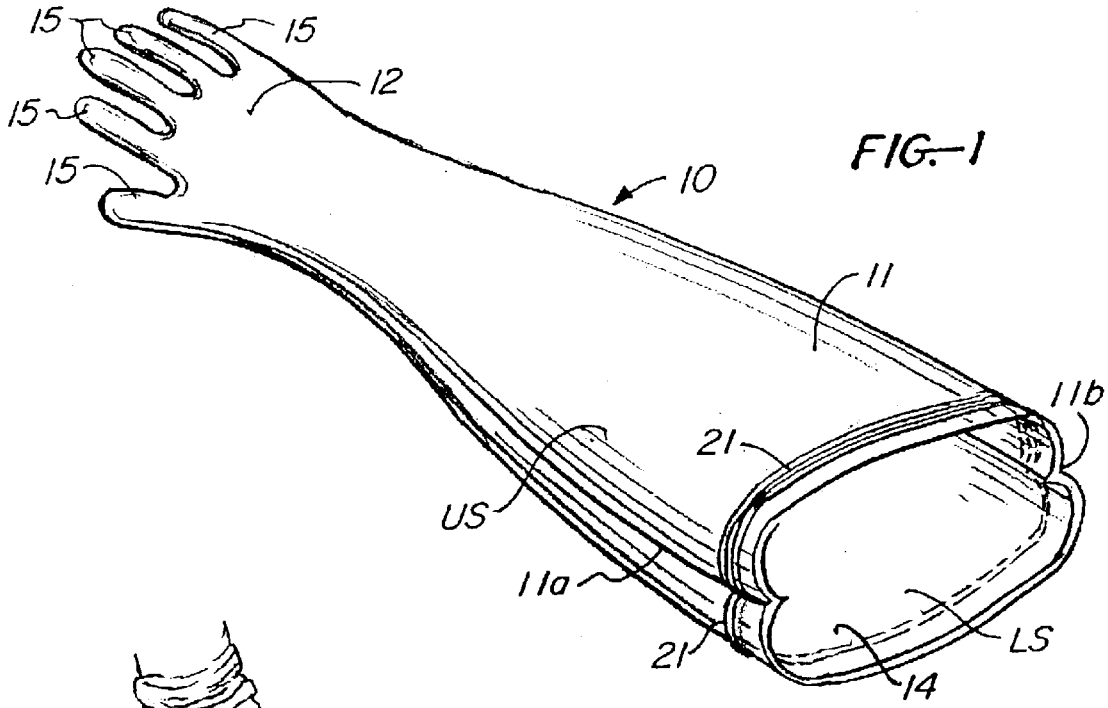
FIG. 1 is a perspective illustration of the inventive manipulation shield in its first implementation.
Figure 2:
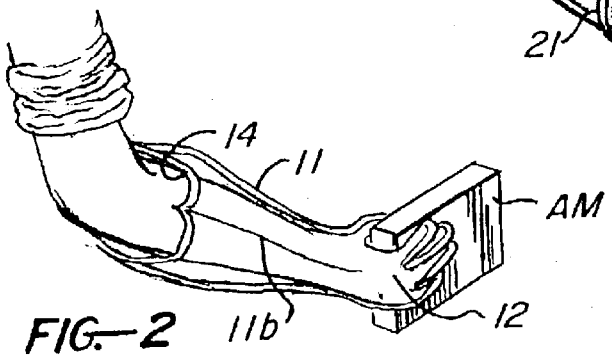
FIG. 2 is a further perspective illustration of the inventive manipulation shield shown in FIG. 1 deployed over the hand and forearm of a user.

As shown in FIGS. 1–5, the inventive manipulation shield, generally designated by the numeral 10, comprises a thin film sleeve 11 extending from the wrist opening of a thin film glove 12 both combined to form a loosely fitted common envelope for receiving the hand, wrist and forearm of a user. Both the glove and the sleeve may be formed from sheet polymer material structure, for example clear polyethylene sheet, by joining or heat welding the peripheral edges of the layered polymer sheeting to define both the glove 12 and the sleeve 11, the glove then further including individual finger envelopes 15 for each of the several digits of the hand. This manner of construction results in an inexpensive envelope or hand shield formed of a thin film that can be worn by a person when manipulating matter held by the gloved fingers. Once so used the sleeve 11 may be inverted and rolled down to extend over the gloved hand grasping any article or matter AM to surround and enclose the article and a sealing strip 21 on the interior of opening 14 into sleeve 11 is then useful to fully enclose the grasped matter. Once thus sealed off the user's hand may be withdrawn from the glove 12, leaving the article AM fully contained either for disposal or for laboratory examination.

Figure 3:
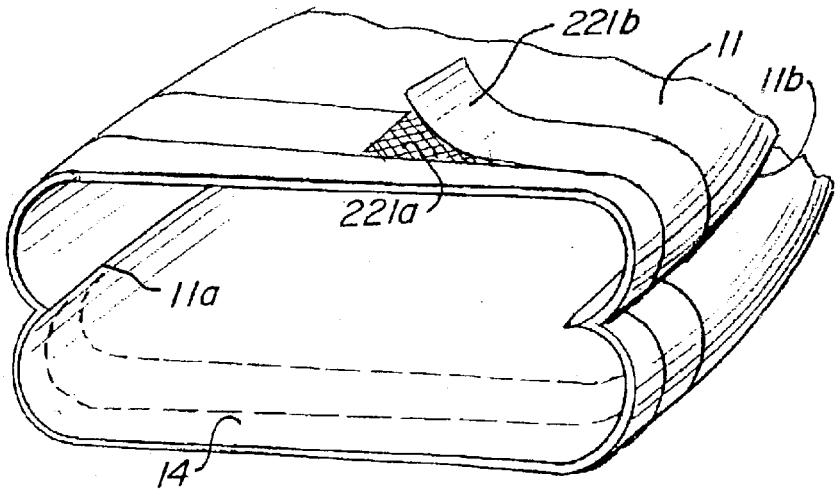
FIG. 3 is a detail view, in perspective, of an alternative sealing mechanism useful with the inventive manipulation shield.
Figure 4:
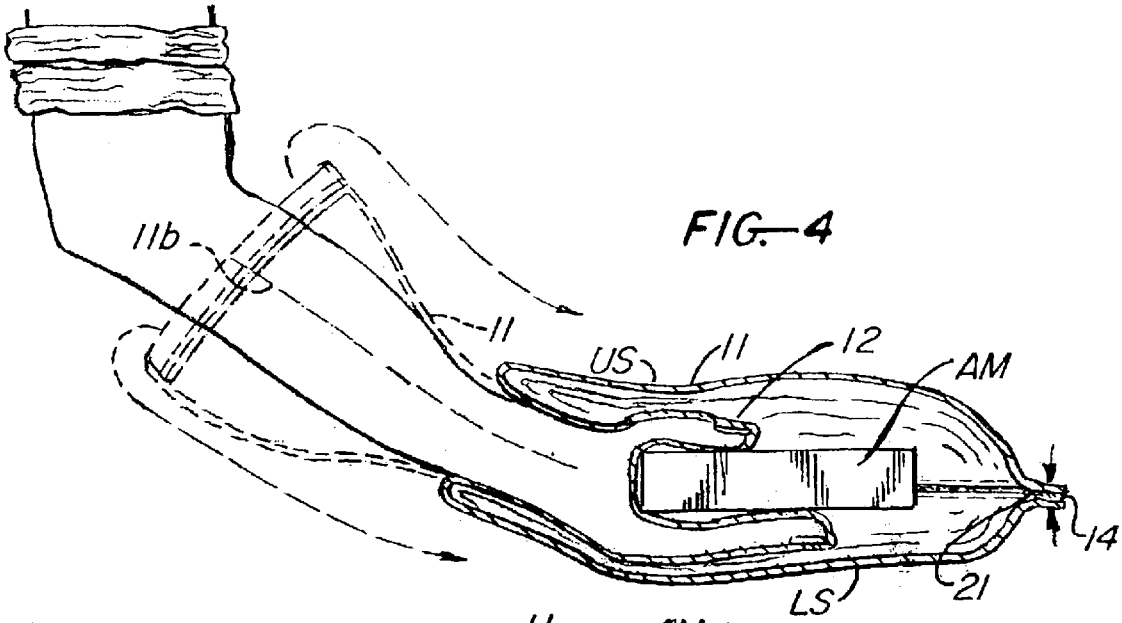
FIG. 4 is yet another perspective illustration of the inventive manipulation shield having a portion thereof inverted to surround an article grasped by the user.
Figure 5:
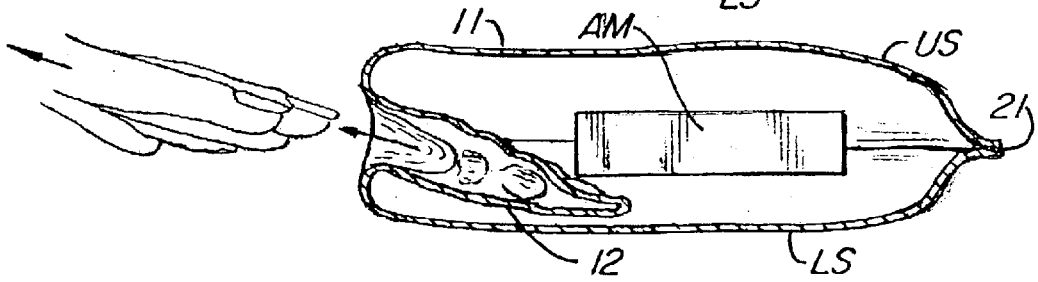
FIG. 5 is a sectional side view of the inventive shield deployed to contain an article suspected to be hazardous.

The general dimensions of the sleeve 11 and of the glove 12 extending therefrom are defined by longitudinal seams 11*a* and 11*b* joining an upper polymer sheet US to a lower sheet LS to each other to form a loose envelope for the arm and the hand, any excess longitudinal dimension of the sleeve being conveniently taken up in a plurality of folds. This general planform shape can further include excess transverse dimension in the sleeve 11 to render convenient the sleeve reversal process described above and to accommodate a variety of shapes and dimensions of the grasped article AM. To effect the sealing strip generally shown at 21 both the upper sheet US and lower sheet LS may include the interlocking beads 121 of a sealing mechanism sold under the mark ZipLoc aligned adjacent the edges forming opening 14. Alternatively, as shown in FIG. 3 an adhesive strip 221*a* covered by a peelable ribbon 221*b* may be utilized, again adjacent the edges of opening 14.

Those in the art will appreciate that the sealing closure of opening 14 needs to be effective only after the sleeve 11 is inverted and rolled down over the gloved hand grasping the article AM. Thus the interlocking sealing ribs 121, or strips 221*a* and their corresponding covering ribbons 221*b*, are deployed on the exterior surfaces of the sleeve 11 when it is worn on the user's arm. In the course of fabrication, however, the interlocking or sealing strips are positioned adjacent each other to assure proper sealing alignment and it is therefore contemplated that the course of fabrication is thereafter followed by a full inversion of the surfaces before vending. This both assures a good eventual seal and furthermore spreads the surfaces from each other in their vended form, thereby rendering convenient the use of the inventive shield.

Figure 6:
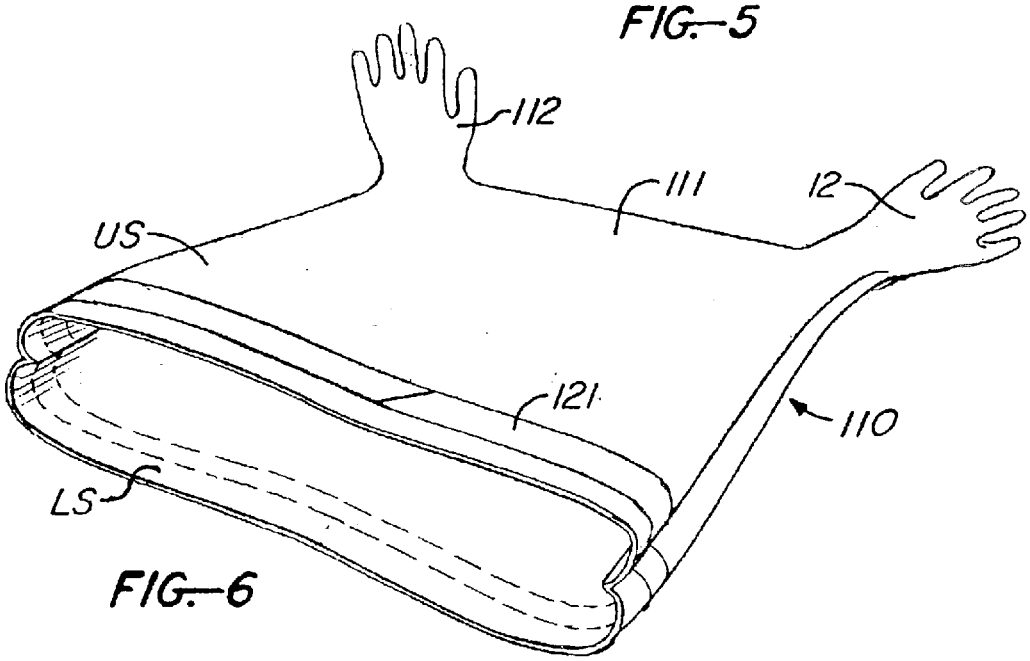
FIG. 6 is a perspective illustration of a further embodiment of the inventive manipulation shield conformed for confining articles requiring two-handed manipulation.
Figure 7:
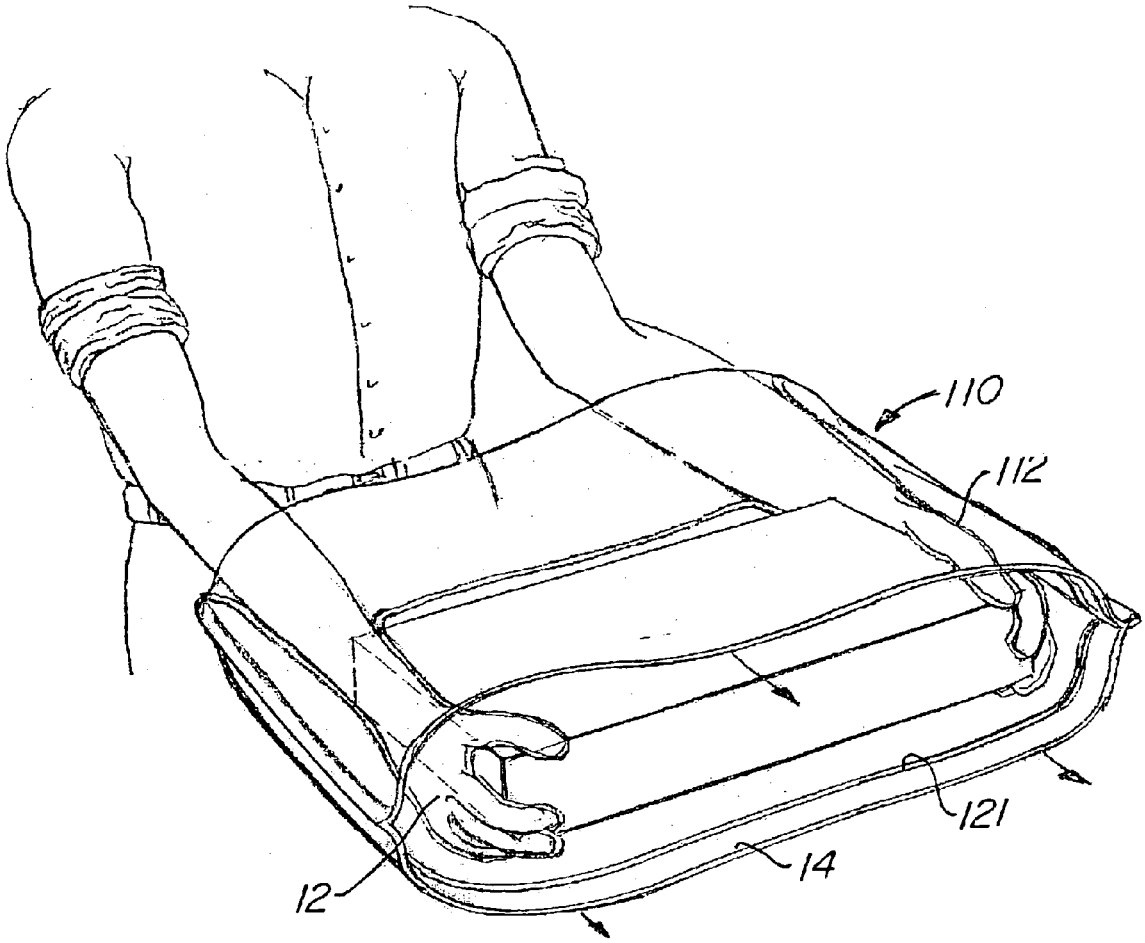
FIG. 7 is yet a further perspective view of the shield shown in FIG. 7 deployed to confine and article.

By further reference to FIGS. 6 and 7 an alternative implementation 110 of the inventive manipulation shield may include an enclosure of substantially larger dimensions useful in confining larger articles. Like numbered parts functioning in a like manner to that earlier described, this enclosure is once more effected by the surfaces of sleeve 11, this time enlarged as a rectangular envelope of substantial dimensions and designated by the numeral 111. As before envelope or sleeve 111 communicates with the glove 12 but because of the difficulty of one handed manipulation of larger articles a second glove 112 is also provided, gloves 12 and 112 being generally deployed at the respective corners of the envelope.

In the course of use the lower surface LS of envelope 111 is allowed to drape onto ground next to the article AM while the user's hands are received within the respective gloves 12 and 112. While thus shielded the user then rolls or otherwise manipulates article AM onto the lower surface LS of envelope 111 and thereafter seals it within the envelope by way of the above described sealing sequences of the interlocking ribs 121 or the exposed adhesive strips 221*b*. The article can then be further visually inspected through the transparent surfaces forming the enclosure 111, may be disposed or may be sent away for further laboratory examination.

In both forms the inventive shield 10 and/or 110 is particularly useful in handling questionable articles delivered by post or other public means of delivery. The recipient can thereby confine the questioned article in an envelope of substantial integrity and may either transfer same to such public agencies assigned to investigate, or may simply defer inspection until the suspicion of terrorist activity is fully resolved. Of course, the inventive shields are also useful to facilitate evidence collection or even as containers for collecting and disposing unsanitary objects or matter.

Both the above described forms, moreover, are particularly suited for high volume production as more precisely described by reference to FIGS. 8 through 11 inclusive. While these illustrations focus on the fabrication of the manipulation shield form designated by the numeral 10 in FIGS. 1–5, it will be appreciated that the same process is also fully useful in forming the envelopes 110 shown in FIGS. 6 and 7. More precisely, the continuous fabrication process illustrated in FIGS. 8 through 11 advances a folded membrane 410 along the direction AA defining a ribbon folded by a longitudinal interlocking edge strip 421. In this form the ribbon is passed subjacent an articulated heater filament carriage generally at 450 from which a heater filament 451 is deployed. While various shapes can be achieved with the use of a heated filament, the filament convolutions illustrated herein are those useful in forming the general planform of the single gloved envelope 10. Of course the planform of the envelope 110 can be similarly implemented in the filament convolutions and no intent to confine the instant fabrication process to a particular envelope shape is expressed by these illustrations.

In its various forms filament 451 is preferably a resistive member bridging across a source of electrical power E that is transported along with the filament carriage 450 along the direction AA of the folded membrane 410 and also cycled periodically along the orthogonal direction BB in the course of each stamping stroke. Those skilled in the art will appreciate that the duration of the filament travel along the path AA with the folded ribbon is determined by the heat levels necessary to effect local ribbon melting and therefore is determined by the membrane thickness, material selection and similar parameters, resulting in a heat welded edge cut 411 approximating the general planform shape of the sleeve 11 and its associated glove 12. Once the ribbon is thus partly severed the carriage 450 is returned to its next starting point to repeat the process. Thus the folded ribbon is severed in a sequence of contiguous edge cuts 411 adjacent the interlocked edge strips 421 with the remainder discarded.

Further along the path of the folded membrane ribbon, now heat stamped into a sequence of edge cuts 411, the interlocked edge strip 421 is separated into the interlocking beads 421*u* and 421*l* by passing over a wedge shaped spreader 431 with each separated edge bead 421*u* and 421*l* then passing into the interior of a corresponding rolling shoe 432*u* and 432*l*. In this manner that portion of the membranes that forms the cuff of each sleeve 11 is reversed and folded over onto a portion of the rest of the sleeve, shown as cuff folds 418*u* and 418*l*. By implementing each of the bead strips 421 as a fully reversible set of interlocking beads permits opposed bead engagement spanning the gaps between the adjacent edges 411. To insure a full bead engagement in this reversed position a set of opposed rollers 433*u* and 433*l* is pressed over the cuff folds 418*u* and 418*l* as the ribbon is advanced from shoes 432*u* and 432*l*, engaging the opposed beads to each other. A further articulated carriage 460 then periodically applies a V-shaped heating filament 461 into these gaps, severing again by heat welded cuts 465 the ribbon 410 into the individual gloved enclosures 10. As particularly illustrated in FIG. 11 the resulting gloved envelope thus obtains the desired bias in the course of fabrication by way of the edge welded and turned cuff segments of the cuff folds 418*u* and 418*l*.

As illustrated in FIG. 12*a* the reversible beaded edge 421 can be conveniently effected by way of opposed bead pairs 521 and 522 on both the surfaces of membrane fold 418*u* and a similarly opposed single bead 523 on both sides of the lower membrane fold 418*l*. Alternatively, as shown in FIG. 12*b*, opposed troughs 531 on both sides of the membrane edge 418*u* may receive one of the opposed matching projections 533 on both sides of membrane 418*l*. Thus the simple reversing convenience allows for the use of a heated filament cutting process that provides the desired biases in the resulting structure. As result a fabrication process is devised for the mass production of the gloved envelopes, in any of their several forms.

Obviously, many modifications and variations of the present invention can be effected without departing from the spirit of the foregoing teachings. It is therefore intended that the scope of the instant invention be determined solely by the claims appended hereto.

It is claimed:

1. A method for fabricating thermoplastic membrane gloved enclosures comprising the steps of:

forming a longitudinally folded membrane ribbon provided with a reversible interlocking bead closure along both the longitudinal free edges thereof;

advancing said folded ribbon subjacent a first articulated carriage provided with a first heater filament convolved to a partial planform of said gloved enclosure;

cyclically articulating said first carriage in coordination with said advancement of said folded ribbon to periodically apply said heater filament against said ribbon for a duration sufficient to melt and sever both fold surfaces of said folded ribbon from the remainder of the ribbon adjacent said filament;

turning said reversible bead closures to overlie in interlocking engagement at the gaps in the ribbon formed by said melting and severing thereof; and cyclically applying a second heater filament to sever the respective ones of said gloved enclosures from each other at said gaps.

2. A method according to claim 1 wherein:

said step of turning said reversible bead closures further includes the step of compressing said bead closures towards each other.

3. A method according to claim 2, wherein:

said step of cyclically articulating further includes the step of supplying electrical power to said first filament; and said step of cyclically applying further includes the step of providing electrical power to said second filament.

4. A method according to claim 1 wherein:

said step of forming said ribbon includes the further step of interlocking said reversible bead closures to each other.

5. A method according to claim 4, wherein:

said step of turning said reversible bead closures further includes the step of separating the opposed ones of said beads from each other.

6. A method according to claim 5 wherein:

said step of turning said reversible bead closures further includes the step of compressing said bead closures towards each other.

7. A method according to claim 6, wherein:

said step of cyclically articulating further includes the step of supplying electrical power to said first filament; and said step of cyclically applying further includes the step of providing electrical power to said second filament.

8. A process for repetitive fabrication of thermoplastic membrane gloved enveloping manipulation enclosures comprising the steps of:

advancing a longitudinally folded thermoplastic membrane ribbon provided with a reversible interlocking bead closure along both the longitudinal free edges thereof subjacent a first articulated carriage provided with a first heater filament convolved to a partial planform of said gloved enclosure;

cyclically articulating said first carriage in coordination with said advancement of said folded ribbon to periodically apply said first heater filament against a portion of said ribbon distal of said bead closure for a duration sufficient to melt and sever both fold surfaces of said folded ribbon from the remainder of the ribbon adjacent said filament;

turning said reversible bead closures to overlie in interlocking engagement at the gaps in the ribbon formed by said melting and severing thereof; and cyclically applying a second heater filament to sever the respective ones of said gloved enclosures from each other at said gaps.

9. A process according to claim 8 wherein:

said step of turning said reversible bead closures further includes the step of compressing said bead closures towards each other.

10. A process according to claim 9, wherein:

said step of cyclically articulating further includes the step of supplying electrical power to said first filament; and said step of cyclically applying further includes the step of providing electrical power to said second filament.

11. A process according to claim 8 wherein:

said step of forming said ribbon includes the further step of interlocking said reversible bead closures to each other.

12. A process according to claim 11, wherein:

said step of turning said reversible bead closures further includes the step of separating the opposed ones of said beads from each other.

13. A process according to claim 12 wherein:

said step of turning said reversible bead closures further includes the step of compressing said bead closures towards each other.

14. A process according to claim 13, wherein:

said step of cyclically articulating further includes the step of supplying electrical power to said first filament; and said step of cyclically applying further includes the step of providing electrical power to said second filament.

* * * * *